United States Patent [19]

Weinstein

[11] Patent Number: 5,058,778

[45] Date of Patent: Oct. 22, 1991

[54] SQUEEZE TYPE DISPENSER HAVING AN AXIALLY ROTATABLE TOP ELEMENT CONTAINING A FLOW CLOSURE AND A VENT

[75] Inventor: Jack Weinstein, Manchester Township, Ocean County, N.J.

[73] Assignee: Primary Deivery Systems, Inc., Annandale, N.J.

[21] Appl. No.: 516,700

[22] Filed: Apr. 27, 1990

[51] Int. Cl.[5] ..... B65D 37/00; B65D 47/00; B67D 3/00

[52] U.S. Cl. ..... 222/209; 222/211; 222/548; 222/555; 222/560; 222/561

[58] Field of Search ..... 222/162, 163, 167, 168, 222/206-215, 519, 520, 555, 559, 560, 561, 548, 549

[56] References Cited

U.S. PATENT DOCUMENTS

| | | | |
|---|---|---|---|
| 2,017,422 | 10/1935 | Shonnard | 222/213 X |
| 2,625,304 | 1/1953 | Mart | 222/211 X |
| 2,895,656 | 7/1959 | Stagmeier | 222/548 X |
| 2,969,167 | 1/1961 | Libit | 222/561 X |
| 2,970,724 | 2/1961 | Lacy | 222/548 X |
| 3,141,579 | 7/1964 | Medlock | 222/213 X |
| 3,338,444 | 8/1967 | Velt | 215/9 |
| 3,409,009 | 11/1968 | Vasse | 222/548 X |
| 3,409,181 | 11/1968 | McDonnell | 222/213 X |
| 4,091,965 | 5/1978 | Goebhard | 222/548 X |
| 4,190,173 | 2/1980 | Mason et al. | 222/548 X |
| 4,286,735 | 9/1981 | Sneider | 222/215 X |
| 4,340,157 | 7/1982 | Darner | 222/211 X |
| 4,585,151 | 4/1986 | Luker | 222/559 X |
| 4,925,068 | 5/1990 | Schneider | 222/548 X |

*Primary Examiner*—Michael S. Huppert
*Assistant Examiner*—Kenneth DeRosa
*Attorney, Agent, or Firm*—Kenneth P. Glynn

[57] ABSTRACT

Squeeze bottle pumpless nozzle dispenser has a first lid, a second lid, a dispensing nozzle, a shut off valve and a dip tube. The first lid, located on the top, has a dispensing orifice upper portion and a venting orifice upper portion. Each of these is located in either a track or a track follower formed in the bottom of the first lid and in alignment therewith. It has means for rotatable attachment to the second lid. The second lid has means for attaching to the squeeze bottle and includes the lower portions of a dispensing orifice and a venting orifice. Each of these is located in either a track or track follower and is located on the top of the second lid in alignment with the counterparts located on the bottom of the first lid. A shut off valve is located within the lower or upper portion of the venting orifice, responsive to pressure. When the bottle is squeezed, the shut off valve will close the vent so that fluid material will only exit through the dispensing orifice and thus through the nozzle. The first lid may be placed in a first position where neither the upper portion of the dispensing orifice nor the upper portion of the venting orifice is in alignment with its lower portion. When the first lid is rotated to a second position, there is simultaneous alignment of the upper and lower portions of both the dispensing orifice and the venting orifice.

10 Claims, 2 Drawing Sheets

SQUEEZE TYPE DISPENSER HAVING AN AXIALLY ROTATABLE TOP ELEMENT CONTAINING A FLOW CLOSURE AND A VENT

BACKGROUND OF THE INVENTION

1. Field of the Invention

The present invention is directed to a squeeze bottle pumpless nozzle dispenser and more particularly to one which has a rotatable top lid which contains the dispensing nozzle. Thus, the present invention is directed to a dispenser which may be squeezed to dispense a fluid material through a nozzle which may take the form of a pump type nozzle but without the need for actual pumping. The particular combination of dispensing and venting is a critical feature of the present invention.

2. Prior Art Statement

Squeeze type dispensers have been around for many years and are exemplified by U.S. Pat. No. 2,017,422 issued in 1935 to O. D. Shonnard. This patent shows a rotatable nozzle which has an open and shut position as well as an intermediate position for dispensing granular materials. U.S. Pat. No. 2,625,304 issued to H. A. Mart on Jan. 13, 1953 describes a fuel dispensing device with a rotatable nozzle which communicates with venting and liquid dispensing openings. U.S. Pat. No. 3,409,181 issued to J. E. McDonnell on Nov. 5, 1968 shows a simple squeeze bottle dispenser and U.S. Pat. No. 4,340,157 shows a state of the art type self-sealing closure dispenser for plastic bottles. This patent issued on July 20, 1982 to James C. Darner and shows a dispenser mechanism with a dual valve arrangement with automatic closure during periods of non-use.

The prior art also shows various types of rotational arrangements for dispensing materials from squeeze type bottles and the like and these are exemplified by U.S. Pat. Nos. 3,141,579; 3,338,444 and 4,585,151. These show various types of rotational arrangements for opening and closing and venting.

Notwithstanding the formidable prior art in this field, none teaches or suggests the system of the present invention involving separate locations and tracks for a dispensing orifice and a venting orifice with a pressure sensitive shut off valve in the venting orifice.

SUMMARY OF THE INVENTION

The present invention is directed to a squeeze bottle pumpless nozzle dispenser. It involves a first lid, a second lid, a dispensing nozzle, a shut off valve, a dip tube and a squeezable container. The first lid, which is located on the top, has a dispensing orifice upper portion and a venting orifice upper portion. Each of these is located in either a track or a track follower which is formed in the bottom of the first lid and in alignment therewith. It also has means for rotatable attachment to the second lid. The second lid has means for attaching to the open neck of the squeezable container and includes the lower portions of a dispensing orifice and a venting orifice. Each of these is located in either a track or track follower and is located on the top of the second lid in alignment with the counterparts located on the bottom of the first lid. Thus, either the first or the second lid may have the track and the other will have the track follower, for each of the two orifices, i.e. the dispensing orifice and the venting orifice. Additionally, a shut off valve is located within the lower portion or the upper portion of the venting orifice and is responsive to pressure such that when the squeeze bottle is squeezed, the shut off valve will close off the vent so that fluid material will only exit through the dispensing orifice and thus through the nozzle. The nozzle is attached to the top of the first lid at the dispensing orifice and the dip tube is attached to the bottom of the second lid at the dispensing orifice. Since the first lid is rotatable relative to the second lid, it may be placed in a first position where neither the upper portion of the dispensing orifice nor the upper portion of the venting orifice are in alignment with the lower portion of the dispensing orifice and the lower portion of the venting orifice. When the first lid is rotated to a second position, there is simultaneous alignment of the upper and lower portions of both the dispensing orifice and the venting orifice.

BRIEF DESCRIPTION OF THE DRAWINGS

The present invention described in this specification will be more fully understood when it is taken in conjunction with the drawings appended herein, wherein.

DETAILED DESCRIPTION OF THE INVENTION

As mentioned, the present invention involves a squeeze bottle pumpless nozzle dispenser. It is referenced as being "pumpless" because it may have the appearance of a pump type dispenser with a similar type of nozzle but will not have to be pumped. In other words, the present invention dispenser can be manually squeezed so that fluid such as hand lotion or other material may be dispensed from the nozzle without actually even picking up the present invention dispenser. Further, a critical feature is the ability to rotate simultaneously both the nozzle and the vent from a closed position to an open position and to have the vent automatically close when the dispenser is being squeezed so that the dispensing fluid only exits from the dispensing nozzle. Further, as soon as the user lets go, the shut off valve in the venting orifice opens up and the air is allowed to enter into the container so as to fill it with adequate air for the next squeeze.

Figure 1:
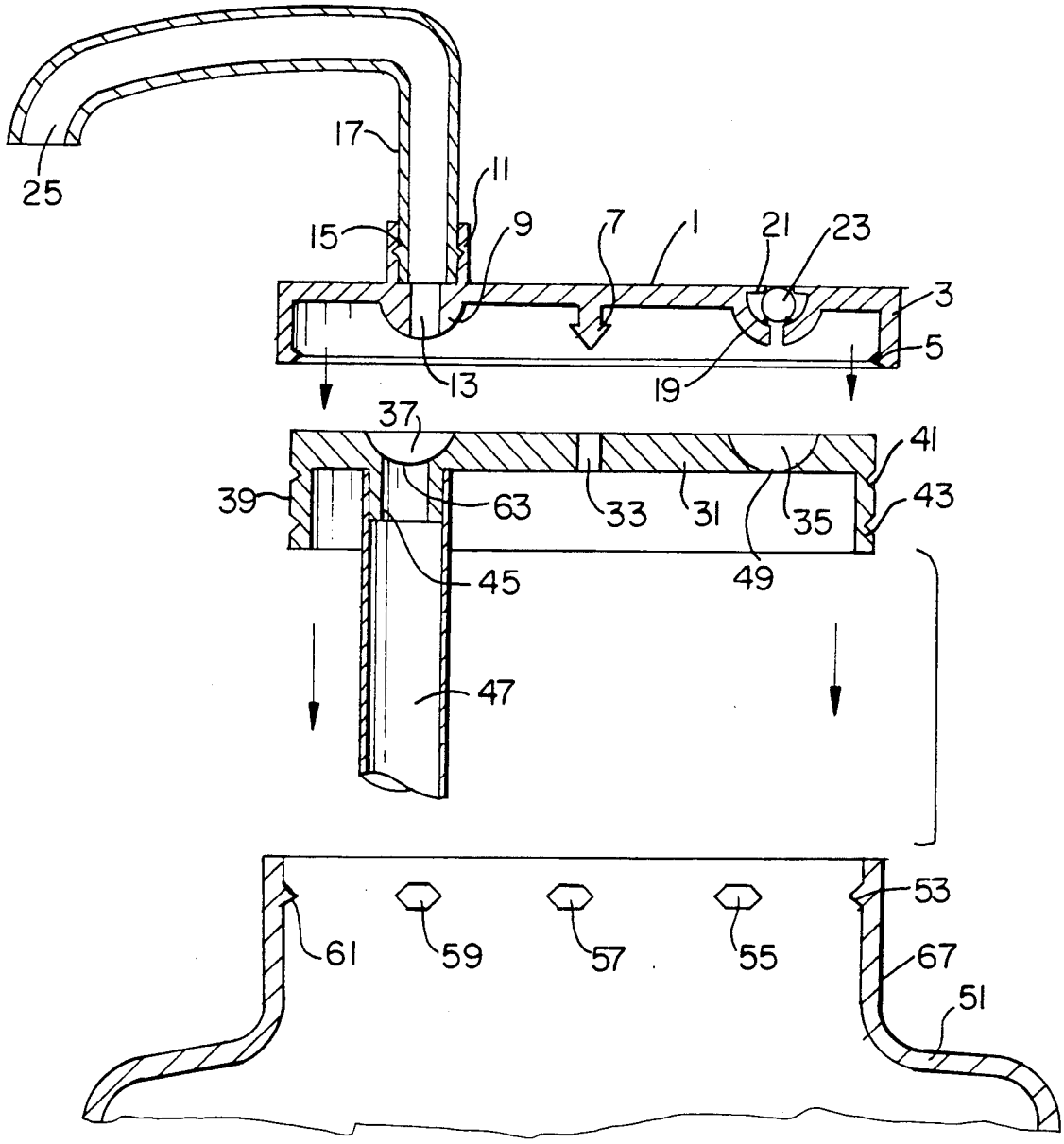
FIG. 1 shows a side cut view of the top of a squeezable container, the first lid, the second lid, the nozzle and other features of a dispenser of the present invention.

Referring now to FIG. 1, there is shown a first lid 1 which has wall 3 and wall lock 5, as shown. In this instance, the wall lock is an extending snap that carries its form around the entire circumference as shown. Thus, when the first lid is attached to a second lid 31, described below, wall lock 5 will keep lid 1 in place on lid 2 but allow its rotation. There is an attachment pin 7 on lid 1 which further facilitates this rotation and acts as the pivot point or axis of rotation. Dispensing orifice track follower 9 is basically a semi-spherical form on the bottom of lid 1 and contains dispensing orifice upper portion 13 as well as dispensing orifice extension 11 which extends upwardly on the top of first lid 1. There is a nozzle lock 15, and nozzle 25 is inserted thereto at nozzle neck 17. Venting orifice track follower 19 also takes the form of a hollow and drilled sphere and contains venting orifice upper portion 21 as well as one way valve 23. In this case, one way valve 23 is a floating ball valve but could easily be a flap valve, a diaphragm valve or any other type of valve which would close from pressure within the container.

Second lid 31 is also shown in its side cut view and includes pin receiver 33 such that attachment pin 7, when inserted thereto, becomes the rotational point of lid 1 as it is rotatable about second lid 31. Second lid 31 also includes a first track 35 which receives venting orifice track 19 of first lid 1 and includes venting orifice lower portion 49 as shown. Likewise, second lid 31 also contains a second track 37 which includes dispensing orifice lower portion 63 and is adapted to receive dispensing orifice track follower 9 of first lid 1. Second lid 31 has a wall 39 which includes continuous lock receiver 41 and fixed lock receiver 43. Continuous lock receiver 41 travels a substantial portion and could travel the entire circumference of wall 39 whereas fixed lock receiver 43 is designed to mate with container body 51 via fixed lock 53 so as to lock the second lid 31 onto the top 67 of container 51 in a non-rotatable or fixed fashion. Dispensing orifice lower portion extension 45 has attached thereto dip tube 47 which is shown segmented. Dip tube 47 would typically be inserted all or substantially all of the length of container body 51 when second lid 31 is attached to container 51. Thus, additional fixed locks 55, 57, 59 and 61 are shown. The type of lock mechanism used to attach first lid 1 to second lid 31 and second lid 31 to container body 51 are not necessarily snap lock type features and any known means could be used. In fact, second lid 31 could actually be irreversibly screwed into container 51, could be melted, heat sealed, glued, or otherwise attached without exceeding the scope of the present invention.

While FIG. 1 shows first lid 1 as having track followers for both the dispensing orifice and the venting orifice and the tracks for each are located in second lid 31, it should now be seen that the track could be located in the first lid and the track follower in the second lid for either the dispensing orifice or the venting orifice or for both.

Figure 2:
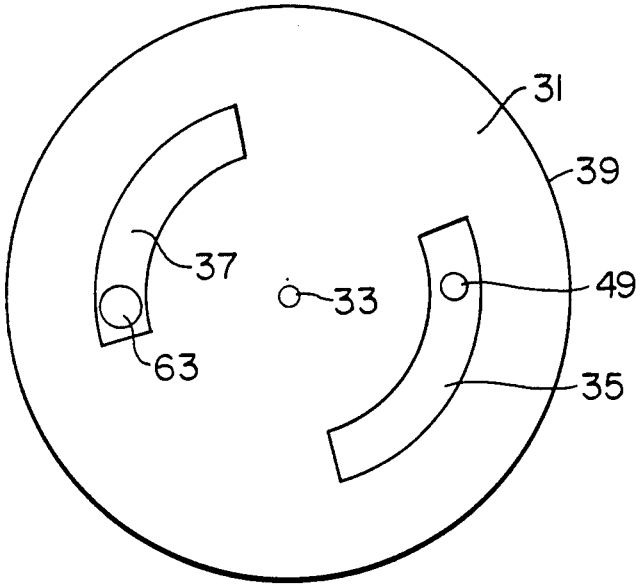
FIG. 2 shows a top view of the second lid which is shown as part of FIG. 1.

Referring to FIG. 2, there is shown a top view of second lid 31. A critical feature of the Present invention is that first track 35 and second track 37 both form arcs of a fixed radius from the center of lid 31 as indicated by pin receiver 33. This enables the track followers 9 and 19 to be rotatably moved along these tracks 35 and 37, during use. As shown in FIG. 2, dispensing orifice lower portion 63 and venting orifice lower portion 49 are opposite one another from pin receiver 33. The lengths of the tracks are not critical and it could be the case that the tracks would be continuous and the two tracks essentially form a single circle. However, in order to limit the rotation of the first lid 1 when it is attached to the second lid 31, tracks 35 and 37 should limited in their length so that the user does not have to perform too much rotation to use the dispenser. Also, it should be noted that the depths, widths and even the radial distance from the center of each of the tracks could vary without exceeding the scope of the invention and they need not be the same for both the first track and the second track. However, in order for the first lid to properly rotate relative to the second lid, there is a need for at least a portion of each of the tracks to have a single fixed radius.

It should now be seen that the first lid 1 can be rotated relative to second lid 31 such that in a first position, the dispensing orifice upper portion 13 and the dispensing orifice lower portion 63 will not be in alignment, nor will the venting orifice upper portion 21 and the venting orifice lower portion 49 be in alignment. When first lid 1 is located to a second position and in this case would be rotated in a counterclockwise fashion, then simultaneously, dispensing orifice upper portion 13 and dispensing orifice lower portion 63 will be in alignment and venting orifice upper portion 21 and venting orifice lower portion 49 will be in alignment. In this position, the user will squeeze the dispenser to dispense liquid from nozzle 25, without the need to even pick up the container 101. Shut off valve 23 will close when it is squeezed and open when it is not squeezed.

Figure 3:
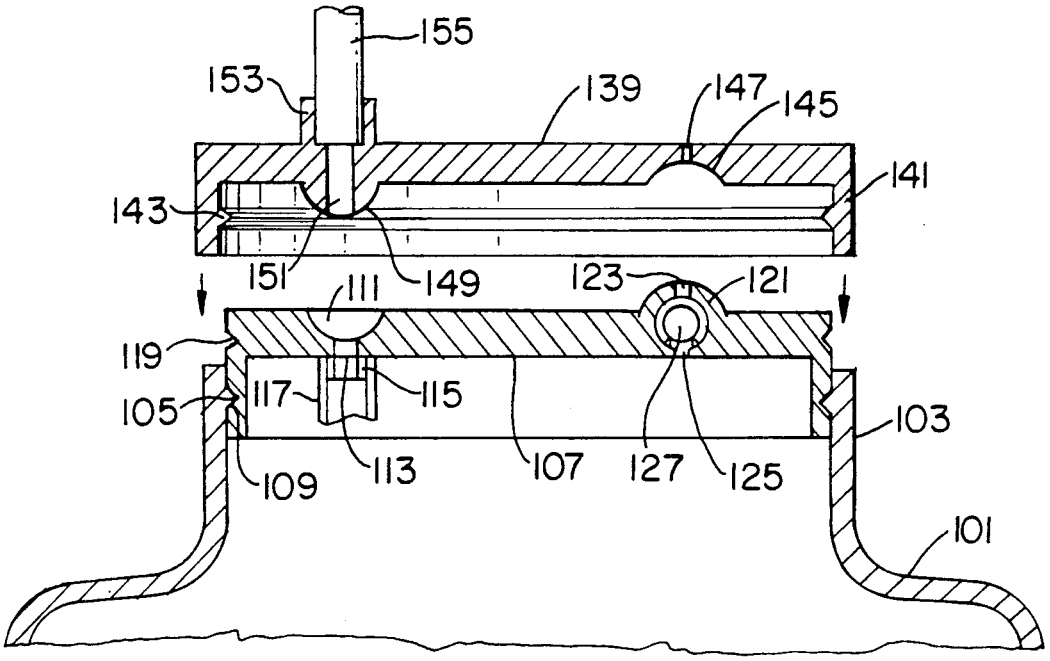
FIG. 3 shows a side cut view of an alternative embodiment dispenser of the present invention wherein the second lid is already located within the open top of a squeezable container and the first lid is shown in the detachable form.

FIG. 3 shows an alternative embodiment wherein container 101 and neck 103 with lock 105 has second lid 107 already inserted therein. Second lid 107 is fixedly attached thereto via lock receiver 109 and similar lock receiver. Second lid 107 includes track 111 which also includes dispensing orifice lower portion 113, extension 115 and dip tube 117. Second lid 107 also includes track follower 121 which includes shut off valve 123 which includes ball 127 and has venting orifice lower portion 125 contained therein. First lid 139 includes wall 141 with continuous lock 143 and has upper portion dispensing orifice 151 and track follower 149, as well as extension 153 and nozzle 155. Additionally, first lid 139 contains track 145, which is inverted and located on the bottom of first lid 139 so as to align and coincide with track follower 121 on second lid 107. Track 145 includes venting orifice upper portion 147. Note that in this embodiment, there is no center attachment means and the lock mechanisms created by, typically, lock 143 and lock receiver 119, are relied upon for attachment.

Obviously, numerous modifications and variations of the present invention are possible in light of the above teachings. It is therefore understood that within the scope of the appended claims, the invention may be practiced otherwise than as specifically described herein.

What is claimed is:

1. A squeeze bottle pumpless nozzle dispenser, which comprises:

(a) a first lid having a top, bottom and wall, and having a dispensing orifice upper portion and a venting orifice upper portion located thereon and having means thereon for rotatable attachment to a second lid;

(b) a dispensing nozzle connected to the top of said lid at the dispensing orifice upper portion;

(c a second lid having a top, bottom and wall with said first lid rotatably connected thereto atop thereof, said second lid having a dispensing orifice lower portion located so as to be alignable with said dispensing orifice upper portion of said first lid and a venting orifice lower portion located so as to be alignable with said venting orifice upper portion of said first lid, and having means for fixed attachment to an open top of a container;

(d) a first track and a first track follower in alignment with one another and movably connected to one another and connected to said dispensing orifice upper portion and said dispensing orifice lower portion;

(e) a second track and a second track follower in alignment with one another and movably connected to one another and connected to said venting orifice upper portion and said venting orifice lower portion;

(f) a shut off valve which closes in response to pressure, located within either the lower portion or the upper portion of said venting orifice;

(g) a squeezable container having an open top and having said second lid fixedly attached to said open top; and, (h) a dip tube connected to said second lid at its bottom at said dispensing orifice lower portion and extending into said squeezable container.

2. The dispenser of claim 1 wherein said tracks and track follower are aligned in an arc of a fixed radius.

3. The dispenser of claim 1 wherein said first lid contains said first track follower with said dispensing orifice upper portion and said second track follower with said venting orifice upper portion, and said second lid contains said first track with said dispensing orifice lower portion and said second track with said venting orifice lower portion.

4. The dispenser of claim 1 wherein said shut off valve is a ball valve.

5. The dispenser of claim 1 wherein said first lid is rotatable to a first position where the upper portion and lower portion of the dispensing orifice are not aligned and the upper portion and lower portion of the venting orifice are not aligned, and said first lid is rotatable to a second position where the upper portion and lower portion of the dispensing orifice and the upper portion and lower portion of the venting orifice are simultaneously in alignment.

6. The dispenser of claim 5 wherein said tracks and track followers are aligned in an arc of a fixed radius.

7. The dispenser of claim 5 wherein said first lid contains said first track follower with said dispensing orifice upper portion and said second track follower with said venting orifice upper portion, and said second lid contains said first track with said dispensing orifice lower portion and said second track with said venting orifice lower portion.

8. The dispenser of claim 5 wherein said shut off valve is a ball valve.

9. The dispenser of claim 1 wherein said nozzle has a pump-like configuration such that the dispenser may dispense from said nozzle into a hand by being squeezed and without being picked up.

10. The dispenser of claim 5 wherein said nozzle has a pump-like configuration such that the dispenser may dispense from said nozzle into a hand by being squeezed and without being picked up.

* * * * *